US011060748B2

(12) United States Patent
Moore

(10) Patent No.: US 11,060,748 B2
(45) Date of Patent: Jul. 13, 2021

(54) METHODS FOR REDUCING ENERGY CONSUMPTION IN A HEATING, VENTILATION AND AIR CONDITIONING (HVAC) SYSTEM

(71) Applicant: Kevin Daniel Martin Moore, Hong Kong (CN)

(72) Inventor: Kevin Daniel Martin Moore, Hong Kong (CN)

( * ) Notice: Subject to any disclaimer, the term of this patent is extended or adjusted under 35 U.S.C. 154(b) by 151 days.

(21) Appl. No.: 16/347,195

(22) PCT Filed: Nov. 8, 2017

(86) PCT No.: PCT/CN2017/109849
§ 371 (c)(1),
(2) Date: May 2, 2019

(87) PCT Pub. No.: WO2018/086521
PCT Pub. Date: May 17, 2018

(65) Prior Publication Data

US 2020/0263892 A1 Aug. 20, 2020

Related U.S. Application Data

(60) Provisional application No. 62/419,956, filed on Nov. 9, 2016.

(51) Int. Cl.
*F24F 11/46* (2018.01)
*F24F 11/64* (2018.01)
(Continued)

(52) U.S. Cl.
CPC ..... *F24F 11/46* (2018.01); *F24F 11/61* (2018.01); *F24F 11/64* (2018.01); *F24F 11/86* (2018.01);
(Continued)

(58) Field of Classification Search
CPC .. F24F 11/46; F24F 11/64; F24F 11/86; F24F 11/61; F24F 2120/10; F24F 2110/10;
(Continued)

(56) References Cited

U.S. PATENT DOCUMENTS 5,388,422 A 2/1995 Hayashida et al.
6,250,382 B1 * 6/2001 Rayburn ..... F24F 3/044 165/248
(Continued)

FOREIGN PATENT DOCUMENTS

CN 2485684 4/2002
CN 101737901 6/2010
(Continued)

*Primary Examiner* — Thomas C Lee
*Assistant Examiner* — Anzuman Sharmin
(74) *Attorney, Agent, or Firm* — Eagle IP Limited; Jacqueline C. Lui

(57) ABSTRACT

A heating, ventilation and air conditioning system (200) reduces energy consumption in a building (202) by turning on and off all compressors (212, 214, 216). The HVAC system (200) includes a plurality of in-flow air temperature sensors (232, 234, 236) and out-flow air temperature sensors (242, 244, 246) that respectively measure return air temperatures at inlets and supply air temperatures at outlets of fan coil units (222, 224, 226) located in rooms (203, 205, 207) of the building (202). The HVAC system (200) turns on and off all the compressor (212, 214, 216) based on the return air temperatures and the supply air temperatures.

15 Claims, 6 Drawing Sheets

(51) Int. Cl.

| | |
|---|---|
| ***F24F 11/86*** | (2018.01) |
| ***F24F 11/61*** | (2018.01) |
| ***F24F 120/10*** | (2018.01) |
| ***F24F 110/10*** | (2018.01) |
| ***F25B 49/02*** | (2006.01) |

(52) U.S. Cl.
CPC ..... *F24F 2110/10* (2018.01); *F24F 2120/10* (2018.01)

(58) Field of Classification Search
CPC ..... F25B 5/00; F25B 2400/075; F25B 2600/0251; F25B 2600/23; F25B 2700/21171; F25B 49/022
See application file for complete search history.

(56) References Cited

U.S. PATENT DOCUMENTS

2003/0155429 A1* 8/2003 Sparling ..... F24F 11/62 236/49.3
2012/0234032 A1 9/2012 Yamashita et al.
2013/0014521 A1* 1/2013 Lukasse ..... F25D 21/04 62/80
2013/0178987 A1 7/2013 Meirav et al.
2013/0220589 A1 8/2013 Liu
2013/0226589 A1 8/2013 Largey et al.
2013/0234032 A1 9/2013 He et al.
2013/0261810 A1* 10/2013 Burton ..... G05B 15/02 700/278
2015/0168043 A1* 6/2015 Moore ..... F25B 49/022 62/115
2015/0204567 A1 7/2015 Sakai et al.
2015/0253020 A1 9/2015 Honda et al.
2015/0300675 A1* 10/2015 Hamada ..... F24F 3/065 62/203
2018/0292102 A1* 10/2018 Mowris ..... F24F 11/46

FOREIGN PATENT DOCUMENTS

CN 102889650 A 1/2013
CN 202709388 1/2013
CN 202973431 6/2013
CN 103486691 A 1/2014
CN 103574842 2/2014
CN 103631349 3/2014
CN 104236023 A 12/2014
JP 10141738 5/1998

* cited by examiner

600

| Test Sites | Chiller Brand | Power | Savings % |
|---|---|---|---|
| Supermarket 1 | Super Air Con | 20 RT | 25 |
| Supermarket 2 | Super Air Con | 200 RT | 20 |
| Supermarket 3 | Super Air Con | 20 RT | 18.6 |
| Bank Branch 1 | Hitachi | 60 RT | 32 |
| Bank Branch 2 | Cheng Hsing | 20 RT | 28 |
| Bank Branch 3 | Hitachi | 30 RT | 25 |
| Academic Test Site 1 | Horng Shiuh Air Con | 25kW (Small unit) | 20 |

Figure 6

METHODS FOR REDUCING ENERGY CONSUMPTION IN A HEATING, VENTILATION AND AIR CONDITIONING (HVAC) SYSTEM

FIELD OF THE INVENTION

This present invention relates to methods that reduce energy consumption in a heating, ventilation and air conditioning (HVAC) system by turning on and off all compressors during the operation of the HVAC system.

BACKGROUND

Unlike the Double Expansion (DX) type of air conditioning where the refrigerant is used for cooling the room directly, in the case of the HVAC systems, the cooling effect from the refrigerant is first transferred to the chilled water, which is then used to chill the air used for cooling a room. As a consequence, HVAC systems are intrinsically less efficient since there is some loss of the cooling effect when it is being transferred from the refrigerant to the chilled water and from the chilled water to air. Due to low energy efficiency, existing HVAC systems suffer from huge energy consumption and running cost.

As central chiller systems are used in large area and district cooling applications, new methods and apparatus that reduce energy consumption in HVAC systems are desirable to assist in advancing technological needs and industrial applications.

BRIEF DESCRIPTION OF THE DRAWINGS

FIG. 6 shows results of energy saving achieved by a method in accordance with an example embodiment.

SUMMARY OF THE INVENTION

Figure 1:
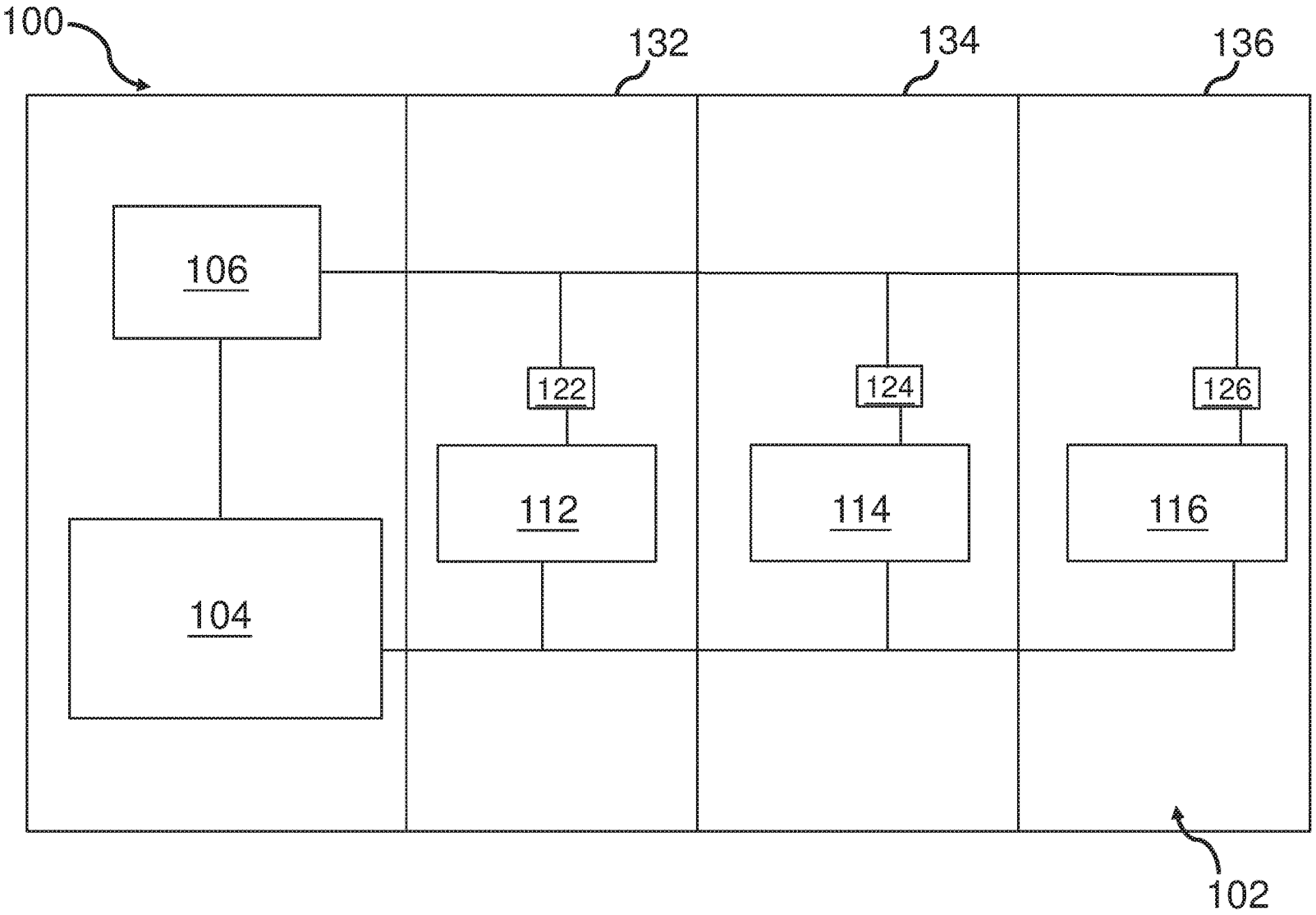
FIG. 1 illustrates a HVAC system in accordance with an example embodiment.

One example embodiment includes a HVAC system that reduces energy consumption in a building. The HVAC system includes a plurality of in-flow air temperature sensors that measure return air temperatures at inlets of fan coil units (FCUs) located in rooms of the building, a plurality of out-flow air temperature sensors that measure supply air temperatures at outlets of the FCUs located in the rooms of the building, a plurality of compressors and condensers that generate high pressure refrigerant to cool and then circulate by means of pumps a refrigeration conduction media through pipes used to cool circulating air through FCUs or Air Handling Units (AHUs) in the rooms, and a processor that receive the return air temperatures and supply air temperatures, and generate electronic signals to control the compressors. If all the return air temperatures are lower than a predetermined temperature for a predetermined period of time; and all the supply air temperatures reach a minimum supply air temperature for the predetermined period of time, the processor generates a first electrical signal to turn off all the plurality of the compressors. Also, if a return air temperature of any one of the plurality of in-flow air temperature sensors is above the predetermined temperature and a supply air temperature of the any one of the plurality of out-flow air temperature sensors reaches a trigger temperature below the predetermined temperature, the processor generates a second electrical signal to turn on all the plurality of the compressors.

Other example embodiments are discussed herein.

DETAILED DESCRIPTION

Example embodiments relate to a heating, ventilation and air conditioning (HVAC) system that reduces energy consumption in a building.

The HVAC system is regarded as an essential part of residential and commercial structures because it maintains the standard of thermal comfort for occupants of the structure. HVAC is used extensively used in a variety of local and district structures, such as factories, warehouses, data centers, single family homes, apartment buildings, hotels, senior living facilities, medium to large industrial and office buildings, hospitals, and other buildings or structures requiring cooling.

The thermal comfort in such buildings is provided through the removal of the heat in the air. In the HVAC system, the heat can be removed through conduction by refrigeration conduction media, such water, air, ice and chemicals known as refrigerants. The refrigeration conduction media is employed in a compressor which is used to generate pressure to drive thermodynamic refrigeration cycle and pumps to circulate the refrigeration conduction media around the pipes in the buildings.

In the HVAC system, the cooling effect is first transferred to the refrigeration conduction media, which is then used to chill the air that is used for cooling a room. The chilled refrigeration conduction media flows into a fan coil unit (FCU) by the pipes, goes through a heat exchanger unit, and returns to the pipes and compressors. A FCU is a device consisting of a cooling heat exchanger and a fan. The air entering the FCU conducts the heat to the refrigeration conduction media, then leaves the FCU. As the refrigeration conduction media evaporates it absorbs heat from the inside air, returns to the compressor, and repeats the cycle. In the process, heat is absorbed from indoors and transferred to outdoors, resulting in cooling of the building.

Being one of the major components in the HVAC system, conventional compressors are energy consuming and expensive to run. These compressors account for a large percentage of the power of a HVAC system.

Conventional HVAC systems make use of large banks of compressors for chilling a large volume of water, which is then circulated around a building or a group of buildings within a district to deliver required area cooling through multiple individual temperature-control equipped AHU or FCU. Further, the chilled water flow has to be pumped over long distances around a whole building. On its way the chilled water gets heated due to friction of flow and also due to surrounding heat absorption. The chilled water also has to be pumped by the pump, which adds more heat to it. Thus, as the chilled water flows from the chiller to the AHU or FCU and again back to the compressors, apart from the heat absorbed from air within individual rooms, the chilled water also absorbs lots of additional heat that leads to an additional increase in water temperature, and the additional increase in water temperature must be removed by the chiller equipment.

Conventional HVAC systems face some very significant process control challenges that increase as the equipment within a building ages. These challenges include a buildup of mineral deposits (e.g. calcium carbonate, etc.) on the inside of water pipes and water control valves; rusting of water valve internals due to oxygen ingress within the circulating water supply; and the temperature sensors associated with individual fan coils/indoor units are usually at height. As heat rises these sensors are unable to register or effectively control required temperature levels. As a consequence of these and other challenges, the result can be over cooling and excessive energy consumption in specific areas within a building because individual water valves are no longer able to respond to required cooling or seat properly closed.

Example embodiments solve problems of conventional HVAC systems. Example embodiments include methods that significantly reduce running costs in a centralized HVAC system and a district HVAC system.

Example embodiments find a balance between thermodynamic work done and hydraulic work done by a compressor(s), which is the main energy consuming component in any HVAC system.

One or more example embodiments ensure a continual supply of the refrigeration conduction media and adopt a thermodynamic or temperature control based on one or more high heat load areas that manages thermal comfort of occupants. Once temperature requirements in the selected high heat load areas are satisfied, all compressors are turned off. These compressors may or may be part of the high heat load areas. As such, a temperature in a high heat load area can control the compressors assigned to and cooling another area. A significant reduction in energy consumption and running costs is achieved due when subject compressors are turned off.

One or more example embodiments improve the efficiency of a HVAC system by controlling the "on" and "off" states of the compressors. In the existing approach, the compressors are kept in operation to maintain supply and return refrigerant temperatures within required ranges. In an example embodiment, all compressors of the HVAC system are switched off when the standard of thermal comfort of occupants in high heat load areas is satisfied.

One or more example embodiments include a HVAC system that requires continuous temperature management in selected high heat load areas within a building. In these example embodiments, the duty cycling of the compressor ON/OFF cycles and production of cooling water or refrigerant are driven by a requirement to deliver cooling to selected high heat load areas only. Meanwhile, the delivery of cooling to other areas of the building (i.e., those not part of the high heat load areas) are managed by individual refrigerant or water valves under local temperature control.

One or more example embodiments include a method that counts numbers of people entering and leaving different rooms of a building by a plurality of counters. When a number of people in any of the rooms is greater than a predetermined number, the HVAC system designates the room(s) as high heat load area(s). By way of example, a memory of a server stores a determination of the high heat load areas in the building based on the number of people in a room or other area. The server includes a processor or processing unit. The processor executes methods in accordance with example embodiments.

By way of example, the high heat load areas are areas where there is a high flow of people. Examples include but are not limited to a cashier area of a retail store (e.g. a supermarket, a grocery store, a department store, etc.), a reception area of an institution (e.g. a hospital, a clinic, a school, etc.). By way of example, areas where there is a low flow of people are not defined as high heat load areas, such as a guest room of a hotel. By way of example, the threshold to determine high heat load area is adjustable or lowered so that there is no single point of temperature monitoring failure. By way of example, the high heat load areas are determined based on the rate at which a designated room or area can be cooled down. By way of example, the high heat load areas are determined based on the functions of the rooms where low temperature is required, such as a computer room, a server room or a laboratory.

One or more exampled embodiments designate one of the rooms as being high heat load area and turned off all the compressors to all rooms when (1) a return air temperature in the one of the rooms is lower than a predetermined temperature for a predetermined period of time and (2) a supply air temperature in the one of the rooms reaches a minimum supply air temperature for the predetermined period of time.

FIG. 1 illustrates a HVAC system 100 in accordance with an example embodiment. As illustrated, the HVAC system 100 resides in a building 102. The HVAC system 100 includes a plurality of compressors 104, a control unit 106 of the HVAC system 100, and a plurality of FCUs 112, 114, and 116, a plurality of air temperature sensors 122, 124 and 126. The building 102 includes a plurality of rooms 132, 134, and 136. The FCUs 112, 114 and 116 reside in each different rooms 132, 134, and 136 in the building 102.

In an example embodiment, the air in the rooms 132, 134, and 136 is drawn into the FCUs 112, 114, and 116 and exchange the heat with the refrigeration conduction media, and then leave the FCUs 112, 114, and 116. By way of example, the refrigeration conduction media is water. The air temperature sensors 122, 124 and 126 measure the return air temperatures at inlets of FCUs 112, 114 and 116, and the supply air temperatures at outlets of the FCUs 112, 114 and 116. If all the return air temperatures are lower than a predetermined temperature for a predetermined period of time; and all the supply air temperatures reach a minimum supply air temperature for the predetermined period of time, the control unit 106 generates a first electrical signal to turn off all the plurality of the compressors 104. Besides, if a return air temperature of any one of the plurality of in-flow air temperature sensors is above the predetermined temperature and a supply air temperature of the any one of the plurality of out-flow air temperature sensors reaches a trigger temperature below the predetermined temperature, the control unit 106 generates a second electrical signal to turn on all the plurality of the compressors 104. In an example embodiment, the predetermined temperature is 24° C. the trigger temperature is 22° C.

In an example embodiment, the control unit 106 determines the minimum supply air temperature by a processor by comparing a newly measured supply air temperature with a previously measured supply air temperature received from the plurality of air temperature sensors 122, 124 and 126; and determining the previously measured supply air temperature as the minimum supply air temperature if the newly measured supply air temperature is greater than or equal to the previously supply air temperature. By way of example, if the newly measured supply air temperature is not less than 20° C. in a period of time, then the 20° C. is determined as the minimum supply air temperature.

Figure 2:
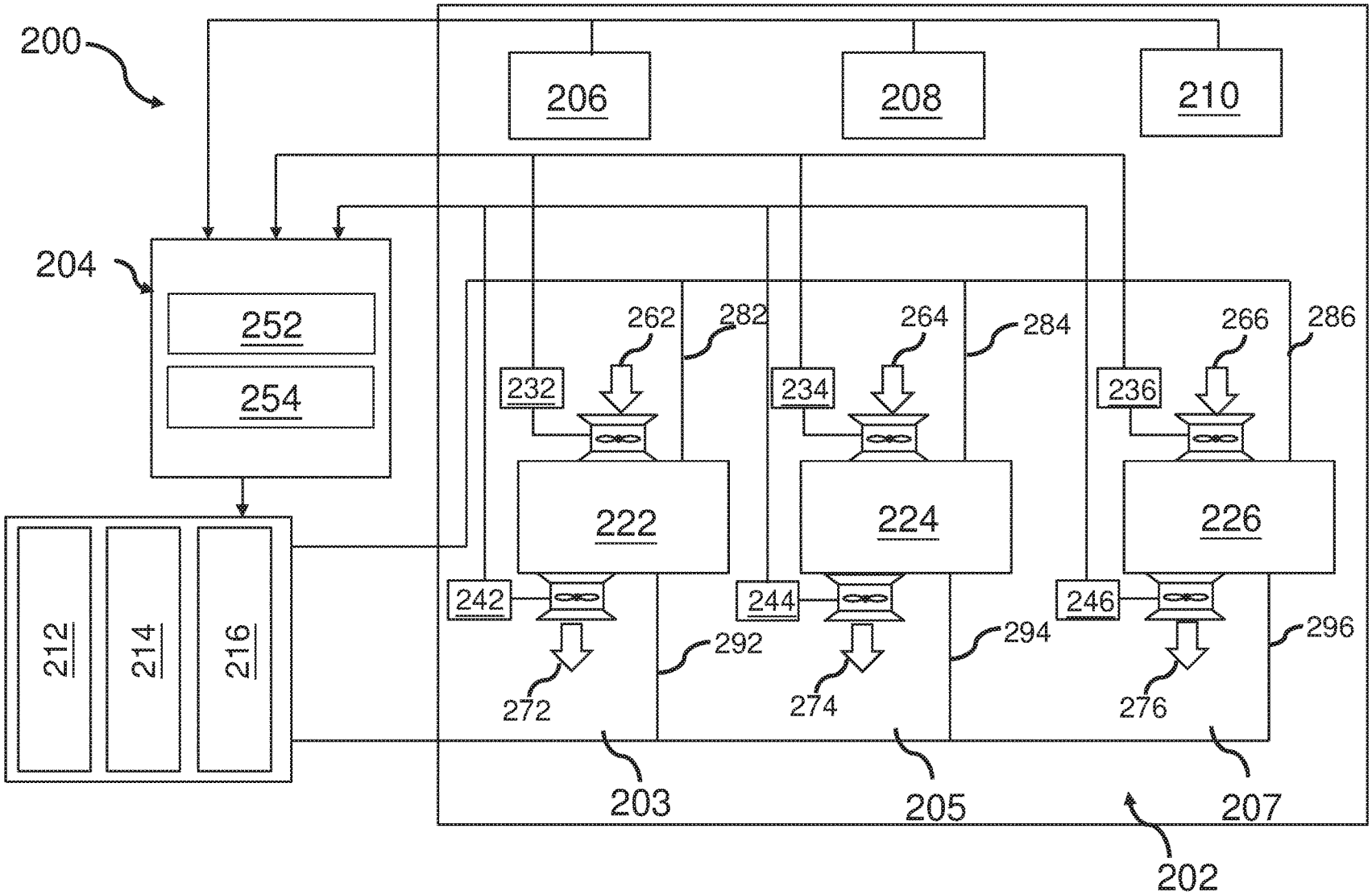
FIG. 2 illustrates a HVAC system in accordance with an example embodiment.

FIG. 2 illustrates a HVAC system in accordance with another example embodiment. As illustrated, the HVAC system 200 resides in a building 202. The building 202 has different rooms 203, 205 and 207. The HVAC system 200 include a control unit 204, a plurality of counters 206, 208 and 210, a plurality of compressors 212, 214, and 216, a plurality of FCUs 222, 224 and 226, a plurality of in-flow air temperature sensors 232, 234 and 236 that reside at inlets of FCUs 222, 224, and 226 located in the rooms 203, 205 and 207 of the building 202, a plurality of out-flow air temperature sensors 242, 244 and 246 that reside at outlets of the FCUs 222, 224 and 226 located in the rooms 203, 205 and 207 of the building 202. The control unit 204 includes a processor 252 and a memory 254.

In an example embodiment, the air in the rooms 203, 205 and 207 is drawn into the FCUs 222, 224 and 226 as return air 262, 264 and 266. The return air 262, 264 and 266 will exchange the heat with the refrigeration conduction media, then the air is blown out of the FCUs 222, 224 and 226 as supply air 272, 274 and 276. By way of example, the refrigeration conduction media is water. The in-flow temperature sensors 232, 234 and 236 reside at inlets of FCUs 222, 224 and 226, and measure the temperatures of return air 262, 264 and 266. The out-flow temperature sensors 242, 244 and 246 reside at outlets of FCUs 222, 224 and 226, and measure the temperatures of supply air 272, 274 and 276.

In an example embodiment, if all temperatures of the return air 262, 264 and 266 are lower than a predetermined temperature for a predetermined period of time; and all temperatures of the supply air 272, 274 and 276 reach a minimum supply air temperature for the predetermined period of time, the control unit 204 generates a first electrical signal to turn off all the plurality of the compressors 212, 214 and 216. Also, if any one of temperatures of the return air 262, 264 and 266 is above the predetermined temperature and an associated temperature of the supply air 232, 234 and 236 reaches a trigger temperature below the predetermined temperature, the control unit 204 generates a second electrical signal to turn on all the plurality of the compressors 212, 214 and 216.

In an example embodiment, the memory 254 stores each measured supply air temperature, the processor 252 determines the minimum supply air temperature by comparing a newly measured supply air temperature with a previously measured temperatures of supply air 272, 274 and 276 received from the plurality of out-flow temperature sensors 242, 244 and 246; and determining the previously measured supply air temperature as the minimum supply air temperature if the newly supply air temperature is greater than or equal to the previously supply air temperature.

In an example embodiment, the processor 252 controls the refrigeration conduction media to continuously circulate in the HVAC system 200 as long as the HVAC system 200 is powered on, and controls the FCUs 222, 224 and 226 to continuously deliver an airflow circulate in the room 203, 205 and 207 as long as the HVAC system 200 is powered on. The in-flow refrigeration conduction media 282, 284 and 286 flow through the FCUs 222, 224 and 226, and absorb the heat from the return air 262, 264 and 266. Then, the refrigeration conduction media flow out of the FCUs 222, 224 and 226. The out-flow refrigeration conduction media 292, 294 and 296 flow into the plurality of compressors 212, 214, and 216 through pipes in the HVAC system 200, and the compressors 212, 214 and 216 generate pressure to circulate the refrigeration conduction media through pipes used to cool circulating air through the rooms 203, 205 and 207 again.

In an example embodiment, a high heat load area is determined by the plurality of counters 206, 208 and 210, the processor 252 and the memory 254. The plurality of counters 206, 208 and 210 count numbers of people in each of the rooms 203, 205 and 207 of the building 202. The numbers of people in each of the rooms stored in the memory 254. Then, the processor 252 receives the number of people in each of the rooms 203, 205 and 207, determines that one of the rooms 203, 205 and 207 has a number of people greater than a predetermined number. Then, the processor 252 selects the one of the rooms 203, 205 and 207 as a high heat load area that controls all the rooms 203, 205 and 207 by turning off all the plurality of compressors 212, 214 and 216 when a return air temperature from the one of the rooms 203, 205 and 207 is lower than the predetermined temperature for the predetermined period of time; and a supply air temperature for the one of the rooms reaches the minimum supply air temperature for the predetermined period of time.

In an example embodiment, the compressors 212, 214 and 216 are turned on after the first electrical signal is generated for a delaying time period. The compressors 212, 214 and 216 are turned off after the second electrical signal is generated for the delaying time period. The delaying time period protects the compressors 212, 214 and 216 from being abnormally switched on and off.

Figure 3:
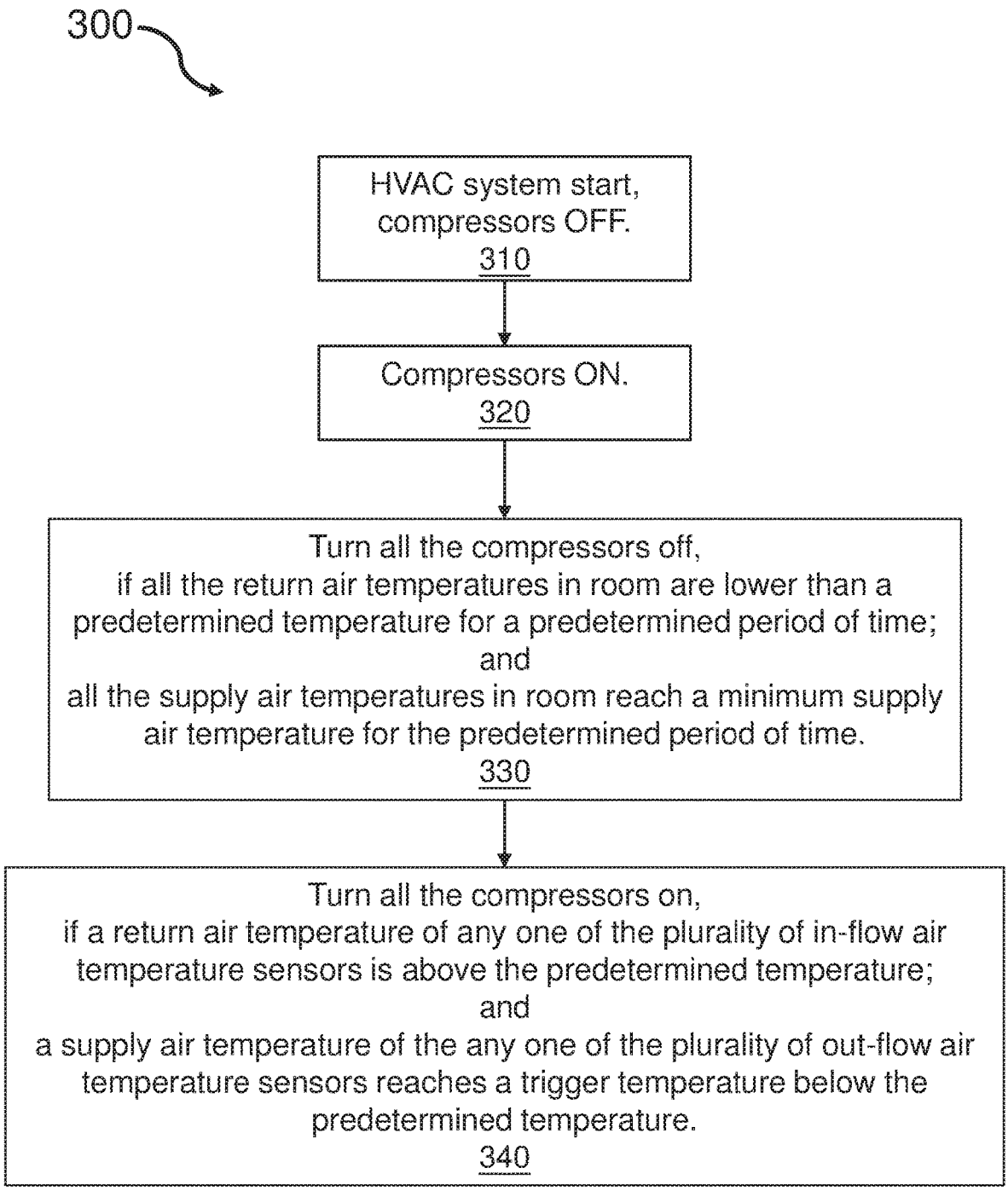
FIG. 3 shows a method that reduces energy consumption of a HVAC system in a building in accordance with an example embodiment.

FIG. 3 shows a method that reduces energy consumption of a HVAC system in a building in accordance with an example embodiment.

Block 310 shows the HVAC system is powered on with the compressors being turned off before the start of the method.

By way of example, the HVAC system starts with the all the compressors are in the OFF state.

Block 320 shows the compressors at next step is turned on and start running.

By way of example, when the HVAC system is powered on, all the compressors are in the ON state, and the HVAC system begins to cool the rooms in the building.

Block 330 shows turning off all the compressors, if all the return air temperatures in rooms of the building are lower than a predetermined temperature for a predetermined period of time; and all the supply air temperatures in rooms of the building reach a minimum supply air temperature for the predetermined period of time.

By way of example, a plurality of in-flow air temperature sensors measure return air temperatures at inlets of fan coil units (FCUs) located in the rooms of the building.

By way of example, a plurality of out-flow air temperature sensors measure supply air temperatures at outlets of the FCUs located in the rooms of the building.

By way of example, a processor receives the return air temperatures and the supply air temperatures and generates a first electronic signal to turn off all compressors.

Block 340 shows turning on all the compressors, if a return air temperature of any one of the plurality of in-flow air temperature sensors is above the predetermined temperature and a supply air temperature of the any one of the plurality of out-flow air temperature sensors reaches a trigger temperature below the predetermined temperature.

By way of example, the processor generates a second electronic signal to turn on all the compressors.

Figure 4:
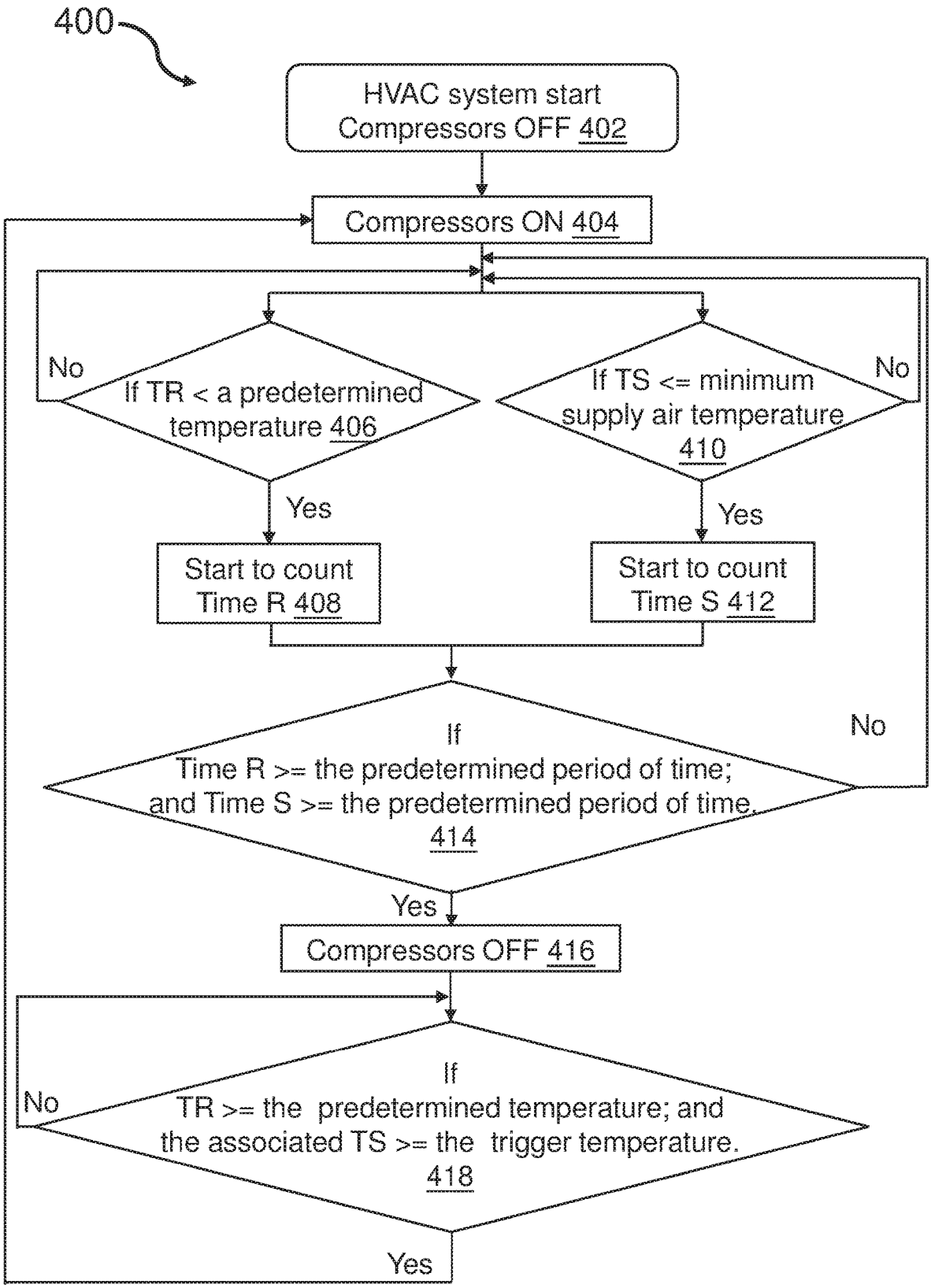
FIG. 4 shows a method that reduces energy consumption of a HVAC system in accordance with an example embodiment.

FIG. 4 shows a method that reduces energy consumption of a HVAC system in accordance with another example embodiment.

Block 402 shows all the compressors are turned off before the HVAC system is powered on.

Block 404 shows all the compressors in the HVAC system are turned on when the HVAC system is powered on and begins to cool the rooms in the building.

In an example embodiment, the HVAC system continuously measures a return temperature (TR) and a supply temperature (TS). TR is measured by a plurality of in-flow air temperature sensors that reside at inlets of FCUs located in rooms of a building. TS is measured by a plurality of out-flow air temperature sensors that reside at outlets of the FCUs located in the rooms of the building.

Block 406 shows if TR is lower than a predetermined temperature, the HVAC system starts to count a first time period (Time R) as shown in block 408.

By way of example, Time R represents the time that the TR is lower than the predetermined temperature. During the counting, if the TR is equal or greater than the predetermined temperature, counting of Time R restart.

By way of example, air in the rooms is drawn into the FCUs through the inlets of FCUs, and exchanges the heat of the air with a chilled refrigeration conduction media. By way of example, the cold refrigeration conduction media is chilled water.

By way of example, TR represents the temperature of the air that is drawn into the FCUs.

Block 410 shows if TS is lower than or equal to a predetermined temperature, the HVAC system starts to count a second time period (Time S) as shown in block 412.

By way of example, Time S represents the time that TS reaches a minimum supply air temperature. During the counting, if the TS is greater than the minimum supply air temperature, the counting of Time S restart.

By way of example, after the air in FCUs exchanges the heat with the cold refrigeration conduction media, the chilled air is erupted from the outlets of FCUs located in rooms.

By way of example, TS represents the temperature of the chilled air that is erupted from the FCUs.

Block 414 shows if Time R and Time S both equal to or greater than a predetermined period of time, the HVAC system send an electrical signal to turn off all the compressors as shown in block 416.

By way of example, if any one of the Time R and Time S does not exceed the predetermined period of time, the HVAC system keeps all the compressors operating, until both of the Time R and Time S exceed the predetermined period of time.

By way of example, if Time R is equal to or greater than a first predetermined period of time and Time S is equal to or greater than a second predetermined period of time, the HVAC system send an electrical signal to turn off all the compressors as shown in Block 416.

By way of example, the first predetermined period of time is different from the second predetermined period of time.

By way of example, the predetermined period of time is three minutes.

After all the compressors are turned off as shown in Block 416, the HVAC system continuously compares the TR with the predetermined temperature, and compares the TS with a trigger temperature.

Block 418 show if TR is greater than or equal to the predetermined temperature, and if TS measured from the associated FCU reaches a trigger temperature below the predetermined temperature, the HVAC system generate another electric signal to turn all the compressors on as shown in Block 404.

By way of example, the trigger temperature is 2° C. below the predetermined temperature.

By way of example, the method continuously delivers a flow of refrigeration conduction media in the HVAC system as long as the HVAC system is powered on, even when the compressors are shut down.

By way of example, the method continuously delivers an airflow through all the fan coils and the air handling units as long as the HVAC system is powered on, even when the compressors are shut down.

By way of example, the method continuously delivers an airflow through all the fan coils and the air handling units in all rooms in the building as long as the HVAC system is powered on.

By way of example, the processor sends and receives communications via a wireless network to and from the plurality of in-flow air temperature sensors, the plurality of out-flow air temperature sensors and all the compressors.

Figure 5:
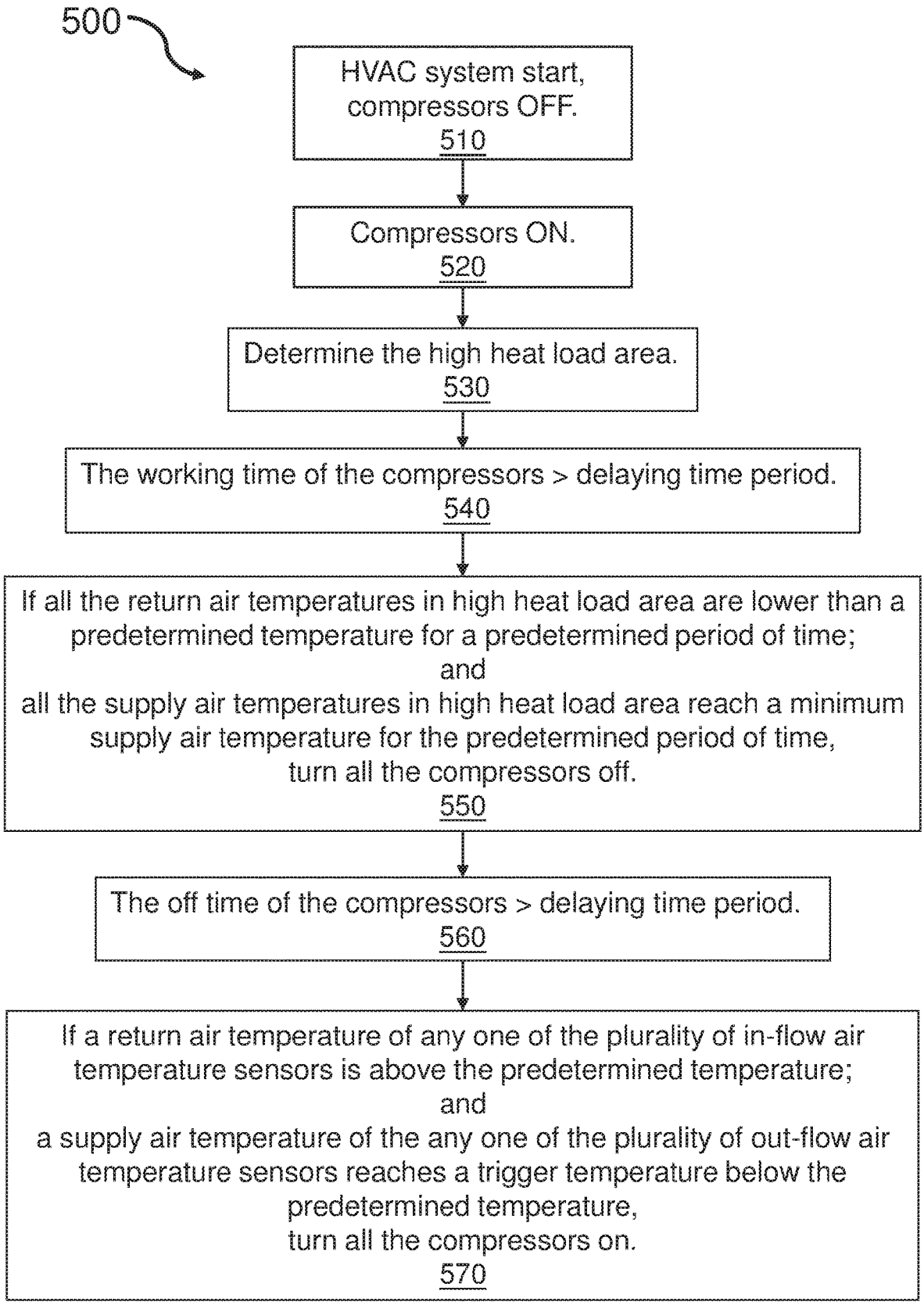
FIG. 5 shows a method that detects a high heat load area and controls the compressors to reduce energy consumption of a HVAC system in accordance with an example embodiment.

FIG. 5 shows a method detects a high heat load area and controls the compressors to reduce energy consumption of a HVAC system in accordance with an example embodiment.

Block 510 shows the HVAC system start with all the compressors off.

Block 520 shows when the HVAC system is powered on, the compressors is also powered on, and the HVAC system starts to cool the rooms in the building.

Block 530 shows the HVAC system determines a high heat load area based on numbers of people in each of the rooms. The HVAC system receives the numbers of people entering and leaving the rooms in the building by a processor. If a number of people in one of the rooms is greater than a predetermined number, then the one of the rooms is designated as a high heat load area.

By way of example, at least one of the rooms is designated as a high heat load area.

By way of example, a plurality of rooms are designated as a high heat load area.

Block 540 shows the HVAC system has a delaying time period in order to protect the compressors from being repeatedly turning on and off in a short period of time.

By way of example, the HVAC system counts the working time of the compressors once the compressors are turn on. If the working time of the compressors exceeds the delaying time period, the HVAC system can turn off the compressors.

Block 550 shows the HVAC system turns off all the compressors if: all the return air temperatures in the high heat load area are lower than a predetermined temperature for a predetermined period of time; and all the supply air temperatures in the high heat load area reach a minimum supply air temperature for the predetermined period of time.

By way of example, the return air temperatures are the temperatures of air which is drawn into the inlets of the FCUs located in the high heat load area in the building.

By way of example, the supply air temperatures are the temperatures of air that is erupted from outlets of the FCUs located in the high heat load area in the building.

By way of example, a processor receives return air temperatures from a plurality of in-flow air temperature sensors at inlets of fan coil units (FCUs) located in rooms of the building.

By way of example, the processor receives supply air temperatures form a plurality of out-flow air temperature sensors at outlets of the FCUs located in the rooms of the building.

By way of example, a first electronic signal is generated to turn off all compressors by the processor.

Block 560 shows HVAC system can turn on the compressors after the off time of the compressors exceeds the delaying time period in order to protect the compressors.

By way of example, the HVAC system turns on all the compressors if a return air temperature of any one of the plurality of in-flow air temperature sensors in high heat load area is above the predetermined temperature and a supply air temperature of the any one of the plurality of out-flow air temperature sensors in the high heat load area reaches a trigger temperature below the predetermined temperature.

By way of example, a second electrical signal is generated to turn on all the compressors.

By way of example, a flow of a refrigeration conduction media in the HVAC system and an airflow through the FCUs are always being delivered as while the HVAC system is powered on.

FIG. 6 shows results of energy saving (in %) achieved by one example embodiment. A method of an example embodiment is applied in each of the seven test sites, which includes three supermarkets, three bank branches, and one academic institution. Comparing with conventional HVAC systems, energy savings of 18.6%-32% are observed by the HVAC systems of example embodiments installed in the test sites.

In some example embodiments, the methods illustrated herein and data and instructions associated therewith are stored in respective storage devices, which are implemented as computer-readable and/or machine-readable storage media, physical or tangible media, and/or non-transitory storage media. These storage media include different forms of memory including semiconductor memory devices such as DRAM, or SRAM, Erasable and Programmable Read-Only Memories (EPROMs), Electrically Erasable and Programmable Read-Only Memories (EEPROMs) and flash memories; magnetic disks such as fixed and removable disks; other magnetic media including tape; optical media such as Compact Disks (CDs) or Digital Versatile Disks (DVDs). Note that the instructions of the software discussed above can be provided on computer-readable or machine-readable storage medium, or alternatively, can be provided on multiple computer-readable or machine-readable storage media distributed in a large system having possibly plural nodes. Such computer-readable or machine-readable medium or media is (are) considered to be part of an article (or article of manufacture). An article or article of manufacture can refer to any manufactured single component or multiple components.

Blocks and/or methods discussed herein can be executed and/or made by a user, a user agent (including machine learning agents and intelligent user agents), a software application, an electronic device, a computer, firmware, hardware, a process, a computer system, and/or an intelligent personal assistant. Furthermore, blocks and/or methods discussed herein can be executed automatically with or without instruction from a user.

The methods in accordance with example embodiments are provided as examples, and examples from one method should not be construed to limit examples from another method. Further, methods discussed within different figures can be added to or exchanged with methods in other figures. Further yet, specific numerical data values (such as specific quantities, numbers, categories, etc.) or other specific information should be interpreted as illustrative for discussing example embodiments. Such specific information is not provided to limit example embodiments. For example, a building may use one or more air handling units (AHUs) to circulate air instead of one or more FCUs, and a building may use both AHUs and FCUs to deliver airflow. For example, FIG. 1 only shows three FCUs, three air temperature sensors and three rooms and FIG. 2 only shows three counters, three compressors, three in-flow air temperature sensors and three out-flow air temperature sensors should be interpreted as illustrative for discussing example embodiments.

As used herein, "continuously" or "continual" means without interruption or gaps.

As used herein, "counter" is a device (such as a sensor) or system that counts a number of a finite set of objects.

As used herein, "thermal comfort" means typically a nationally defined standard or a generally acceptable temperature and humidity level.

What is claimed is:

1. A heating, ventilation and air conditioning (HVAC) system that reduces energy consumption in a building, the HVAC system comprising:

a plurality of in-flow air temperature sensors that reside at inlets of fan coil units (FCUs) located in rooms of the building;

a plurality of out-flow air temperature sensors that reside at outlets of the FCUs located in the rooms of the building;

a plurality of compressors that generate pressure to circulate a refrigeration conduction media through pipes used to cool circulating air through the rooms;

a processor;

a non-transitory computer-readable medium having stored therein instructions that when executed cause the processor to:

receive return air temperatures measured from the plurality of in-flow air temperature sensors;

receive supply air temperatures measured from the plurality of out-flow air temperature sensors;

generate a first electrical signal to turn off all the plurality of compressors if:

all the return air temperatures are lower than a predetermined temperature for a predetermined period of time; and all the supply air temperatures reach a minimum supply air temperature for the predetermined period of time;

generate a second electrical signal to turn on all the plurality of compressors if:

a return air temperature of any one of the plurality of in-flow air temperature sensors is above the predetermined temperature; and a supply air temperature of the any one of the plurality of out-flow air temperature sensors reaches a trigger temperature below the predetermined temperature;

wherein the minimum supply air temperature is determined by the processor by:

comparing, continuously, a newly measured supply air temperature with a previously measured supply air temperature received from the plurality of out-flow air temperature sensors; and determining the previously measured supply air temperature as the minimum supply air temperature if the newly supply air temperature is greater than or equal to the previously supply air temperature.

2. The HVAC system of claim 1, wherein the trigger temperature is 2° C. below the predetermined temperature.

3. The HVAC system of claim 1, wherein a flow of the refrigeration conduction media in the HVAC system and an airflow through the FCUs are always being delivered as while the HVAC system is powered on.

4. The HVAC system of claim 1, wherein the plurality of compressors are turned on after the first electrical signal to turn off all the plurality of compressors is generated for a delaying time period, and the plurality of compressors are turned off after the second electrical signal to turn on all the plurality of compressors is generated for the delaying time period.

5. The HVAC system of claim 1, wherein the processor further executes the instructions to:

receive a number of people in each of the rooms;

determine that one of the rooms has a number of people greater than a predetermined number;

select the one of the rooms as a high heat load area that controls all the rooms by turning off all the plurality of compressors when:

a return air temperature from the one of the rooms is lower than the predetermined temperature for the predetermined period of time; and a supply air temperature for the one of the rooms reaches the minimum supply air temperature for the predetermined period of time;

count, by a plurality of counters, numbers of people entering and leaving different rooms of the building; and store, in a memory of a server, a determination of the high heat load areas in the building based on the numbers of people.

6. A method that reduces energy consumption of a heating, ventilation and air conditioning (HVAC) system in a building, the method comprising:

measuring, by a plurality of in-flow air temperature sensors, return air temperatures at inlets of fan coil units (FCUs) located in rooms of the building;

measuring, by a plurality of out-flow air temperature sensors, supply air temperatures at outlets of the FCUs located in the rooms of the building;

receiving, by a processor, the return air temperatures and the supply air temperatures;

generating a first electronic signal to turn off all compressors, by the processor, if:

all the return air temperatures are lower than a predetermined temperature for a predetermined period of time; and all the supply air temperatures reach a minimum supply air temperature for the predetermined period of time;

wherein the method further comprises:

continuously delivering a flow of refrigeration conduction media in the HVAC system as long as the HVAC system is powered on;

continuously delivering an airflow through all the fan coils and the air handling units as long as the HVAC system is powered on; and determining, by the processor, the minimum supply air temperature by:

comparing a newly measured supply air temperature with a previously measured supply air temperature; and determining the previously measured supply air temperature as the minimum supply air temperature if the newly supply air temperature is greater than or equal to the previously supply air temperature.

7. The method of claim 6, further comprising:

generating a second electronic signal to turn on all the compressors, by the processor, if:

a return air temperature of any one of the plurality of in-flow air temperature sensors is above the predetermined temperature; and a supply air temperature of the any one of the plurality of out-flow air temperature sensors reaches a trigger temperature below the predetermined temperature.

8. The method of claim 6, further comprising:

counting, by a plurality of counters, a number of people in each of the rooms;

designating one of the rooms as being a high heat load area when a number of people in the one of the rooms is greater than a predetermined number; and turning off all the compressors to all rooms when (1) a return air temperature in the one of the rooms is lower than the predetermined temperature for the predetermined period of time and (2) a supply air temperature in the one of the rooms reaches the minimum supply air temperature for the predetermined period of time.

9. The method of claim 6, wherein the trigger temperature is 2° C. below the predetermined temperature.

10. The method of claim 6, further comprising:

sending and receiving communications, by the processor via a wireless network, to and from the plurality of in-flow air temperature sensors, the plurality of out-flow air temperature sensors and all the compressors.

11. A method that reduces energy consumption in a heating, ventilation and air conditioning (HVAC) system in a building, the method comprising:

receiving, by a processor, return air temperatures from a plurality of in-flow air temperature sensors at inlets of fan coil units (FCUs) located in rooms of the building;

receiving, by the processor, supply air temperatures from a plurality of out-flow air temperature sensors at outlets of the FCUs located in the rooms of the building;

generating a first electronic signal to turn off all compressors, by the processor, if:

all the return air temperatures are lower than a predetermined temperature for a predetermined period of time; and all the supply air temperatures reach a minimum supply air temperature for the predetermined period of time; and generating a second electrical signal to turn on all the compressors, by the processor, if:

a return air temperature of any one of the plurality of in-flow air temperature sensors is above the predetermined temperature; and a supply air temperature of the any one of the plurality of out-flow air temperature sensors reaches a trigger temperature below the predetermined temperature;

wherein the method further comprises:

continuously delivering a flow of water in the HVAC system as long as the HVAC system is powered on;

continuously delivering an airflow through all the fan coils and the air handling units as long as the HVAC system is powered on; and determining, by the processor, the minimum supply air temperature by:

comparing a newly measured supply air temperature with a previously measured supply air temperature; and determining the previously measured supply air temperature as the minimum supply air temperature if the newly supply air temperature is greater than or equal to the previously supply air temperature.

12. The method of claim 11, further comprising:

receiving, by the processor, numbers of people entering and leaving the rooms;

designating one of the rooms as being a high heat load area when a number of people in the one of the rooms is greater than a predetermined number; and turning off all the compressors to all rooms when (1) a return air temperature in the one of the rooms is lower than the predetermined temperature for the predetermined period of time and (2) a supply air temperature in the one of the rooms reaches the minimum supply air temperature for the predetermined period of time.

13. The method of claim 11, further comprising:

turning off all the compressors after the first electronic signal is generated by the processor for a delaying time period; and turning on all the compressors after the second electronic signal is generated by the processor for the delaying time period.

14. The method of claim 11, wherein the trigger temperature is 2° C. below the predetermined temperature.

15. The method of claim 11, wherein the predetermined period of time is one minute.

* * * * *